US008571871B1

(12) United States Patent
Stuttle et al.

(10) Patent No.: US 8,571,871 B1
(45) Date of Patent: Oct. 29, 2013

(54) METHODS AND SYSTEMS FOR ADAPTATION OF SYNTHETIC SPEECH IN AN ENVIRONMENT

(71) Applicant: Google Inc., Mountain View, CA (US)

(72) Inventors: Matthew Nicholas Stuttle, Sussex (GB); Ioannis Agiomyrgiannakis, London (GB)

(73) Assignee: Google Inc., Mountain View, CA (US)

( * ) Notice: Subject to any disclaimer, the term of this patent is extended or adjusted under 35 U.S.C. 154(b) by 0 days.

(21) Appl. No.: 13/633,231

(22) Filed: Oct. 2, 2012

(51) Int. Cl.
*G10L 13/08* (2013.01)

(52) U.S. Cl.
USPC ..... 704/260

(58) Field of Classification Search
USPC ..... 704/260
See application file for complete search history.

(56) References Cited

U.S. PATENT DOCUMENTS

| | | | | |
|---|---|---|---|---|
| 5,742,928 | A | 4/1998 | Suzuki | |
| 5,864,809 | A | 1/1999 | Suzuki | |
| 2003/0061049 | A1 | 3/2003 | Erten | |
| 2003/0182114 | A1* | 9/2003 | Dupont | 704/233 |
| 2004/0230420 | A1* | 11/2004 | Kadambe et al. | 704/205 |
| 2007/0129022 | A1* | 6/2007 | Boillot et al. | 455/90.1 |
| 2007/0239444 | A1* | 10/2007 | Ma | 704/233 |
| 2007/0253578 | A1* | 11/2007 | Verdecanna et al. | 381/104 |
| 2008/0189109 | A1* | 8/2008 | Shi et al. | 704/240 |
| 2009/0076819 | A1* | 3/2009 | Wouters et al. | 704/260 |
| 2009/0192705 | A1* | 7/2009 | Golding et al. | 701/201 |
| 2010/0057465 | A1* | 3/2010 | Kirsch et al. | 704/260 |
| 2013/0013304 | A1* | 1/2013 | Murthy et al. | 704/226 |

OTHER PUBLICATIONS

Tuomo Raitio, "Analysis of HMM-Based Lombard Speech Synthesis," in Proc. Interspeech, Florence, Italy, Aug. 2011.
Gopala Krishna Anumanchipalli, "Improving Speech Synthesis for Noisy Environments," 7th ISCA Workshop on Speech Synthesis (SSW-7) Kyoto, Japan, Sep. 22-24, 2010.
Junichi Yamagishi, "HMM-Based Expressive Seech Synthesis—Towards TTS With Arbitrary Sspeaking Styles and Emotions," Proc. of Special Workshop in Maui (SWIM), 2004.
Takayoshi Yoshimura, "Speaker interpolation for HMM-based speech synthesis system," Proc. of EUROSPEECH, vol. 5, pp. 2523-2526, 1997.

* cited by examiner

*Primary Examiner* — Jakieda Jackson
(74) *Attorney, Agent, or Firm* — McDonnell Boehnen Hulbert and Berghoff

(57) ABSTRACT

Methods and systems for adaptation of synthetic speech in an environment are described. In an example, a device, which may include a text-to-speech (TTS) module, may be configured to determine characteristics of an environment of the device. The device also may be configured to determine, based on the one or more characteristics of the environment, speech parameters that characterize a voice output of the text-to-speech module. Further, the device may be configured to process a text to obtain the voice output corresponding to the text based on the speech parameters to account for the one or more characteristics of the environment.

17 Claims, 9 Drawing Sheets

METHODS AND SYSTEMS FOR ADAPTATION OF SYNTHETIC SPEECH IN AN ENVIRONMENT

BACKGROUND

Recently, interest has been shown in use of voice interfaces for computing devices. In particular, voice interfaces are becoming more common for devices often used in "eyes-busy" and/or "hands-busy" environments, such as smart phones or devices associated with vehicles. In many scenarios, devices in eyes-busy and/or hands-busy environments are asked to perform repetitive tasks, such as, but not limited to, searching the Internet, looking up addresses, and purchasing goods or services.

An example voice interface includes a speech-to-text system (or text-to-speech (TTS) system) that converts normal language into speech (or text into speech). Other systems are available that may render symbolic linguistic representations like phonetic transcriptions into speech to facilitate voice interfacing. Speech synthesis is artificial production of human speech. A computer system used for this purpose is called a speech synthesizer, and can be implemented in software or hardware.

BRIEF SUMMARY

The present application discloses systems and methods for adaptation of synthetic speech in an environment. In one aspect, a method is described. The method may comprise determining one or more characteristics of an environment of a device. The device may include a text-to-speech module. The method also may comprise determining, based on the one or more characteristics of the environment, one or more speech parameters that characterize a voice output of the text-to-speech module. The method further may comprise processing, by the text-to-speech module, a text to obtain the voice output corresponding to the text based on the one or more speech parameters to account for the one or more characteristics of the environment.

In another aspect, a system is described. The system may comprise a device including a text-to-speech module. The system also may comprise a processor coupled to the device, and the processor is configured to determine one or more characteristics of an environment of the device. The processor also may be configured to determine, based on the one or more characteristics of the environment, one or more speech parameters that characterize a voice output of the text-to-speech module. The processor further may be configured to process a text to obtain the voice output corresponding to the text based on the one or more speech parameters to account for the one or more characteristics of the environment.

In still another aspect, a computer readable medium having stored thereon instructions that, when executed by a computing device, cause the computing device to perform functions is described. The functions may comprise determining one or more characteristics of an environment. The functions also may comprise determining, based on the one or more characteristics of the environment, one or more speech parameters that characterize a voice output of a text-to-speech module coupled to the computing device. The functions further may comprise processing, by the text-to-speech module, a text to obtain the voice output corresponding to the text based on the one or more speech parameters to account for the one or more characteristics of the environment.

The foregoing summary is illustrative only and is not intended to be in any way limiting. In addition to the illustrative aspects, embodiments, and features described above, further aspects, embodiments, and features will become apparent by reference to the figures and the following detailed description.

DETAILED DESCRIPTION

The following detailed description describes various features and functions of the disclosed systems and methods with reference to the accompanying figures. In the figures, similar symbols identify similar components, unless context dictates otherwise. The illustrative system and method embodiments described herein are not meant to be limiting. It may be readily understood that certain aspects of the disclosed systems and methods can be arranged and combined in a wide variety of different configurations, all of which are contemplated herein.

With the increase in the power and resources of computer technology, building natural-sounding synthetic voices has progressed from a knowledge-based activity to a data-based one. Rather than hand-crafting each phonetic unit and applicable contexts of each phonetic unit, high-quality synthetic voices may be built from sufficiently diverse single-speaker databases of natural speech. Diphone systems may be configured to use fixed inventories of pre-recorded speech. Other techniques such as unit-selection synthesis may include using sub-word units (pre-recorded waveforms) selected from large databases of natural speech. In unit-selection techniques synthesis, quality of output may derive directly from quality of recordings; thus, the larger the database the better the quality. Further, limited domain synthesizers, where the database has been designed for a particular application, may be configured to optimize synthetic output.

Figure 1A:
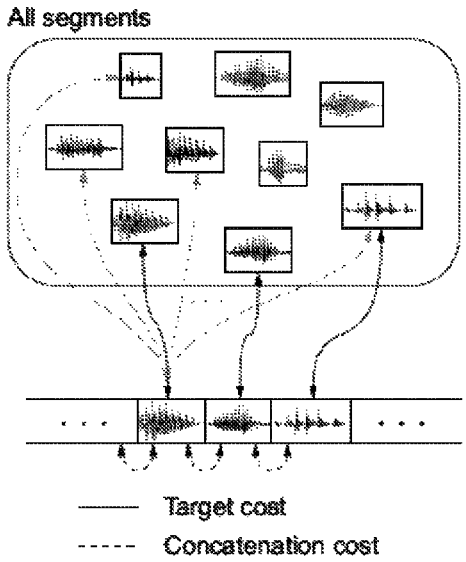
FIG. 1A illustrates an overview of an example general unit-selection technique, in accordance with an embodiment.

A basic unit-selection premise is that new naturally sounding utterances can be synthesized by selecting appropriate sub-word units from a database of natural speech. FIG. 1A illustrates an overview of an example general unit-selection technique, in accordance with an embodiment. FIG. 1A illustrates use of a target cost, i.e., how well a candidate unit from a database matches a required unit, and a concatenation cost, which defines how well two selected units may be combined. The target cost between a candidate unit, $u_i$, and a required unit, $t_i$, may be represented by the following Equation:

$$C^t(t_i, u_i) = \sum_{j=1}^{p} w_j^t C_j^t(t_i, u_i) \quad \text{Equation (1)}$$

where j indexes over all features (phonetic and prosodic contexts may be used as features), C is the target cost, and $w_j$ is a weight associated with the j-th target cost. The concatenation cost can be defined as:

$$C^c(u_{i-1}, u_i) = \sum_{k=1}^{p} w_k^c C_k^c(u_{i-1}, u_i) \quad \text{Equation (2)}$$

In examples, k may include spectral and acoustic features.

The target cost and the concatenation cost may then be optimized to find a string of units, $u_1^n$, from the database that minimizes an overall cost, $C(t_1^n, u_1^n)$, as:

$$\hat{u}_1^n = \underset{u_1^n}{\operatorname{argmin}}\{C(t_1^n, u_1^n)\} \quad \text{Equation (3)}$$

where:

$$C(t_1^n, u_1^n) = \sum_{i=1}^{n} C^t(t_i, u_i) + \sum_{i=2}^{n} C^c(u_{i-1}, u_i) \quad \text{Equation (4)}$$

Figure 1B:
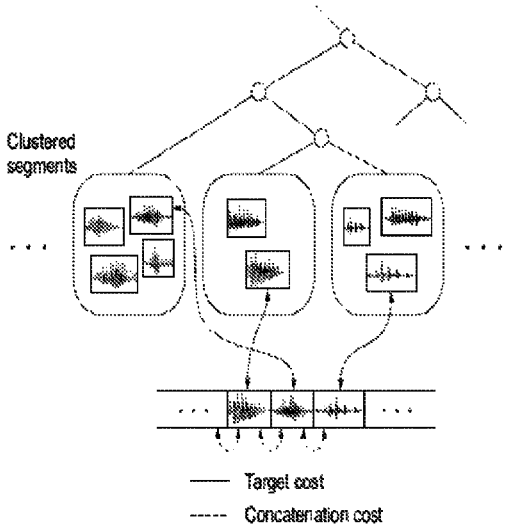
FIG. 1B illustrates an overview of an example clustering-based unit-selection technique, in accordance with an embodiment.

FIG. 1B illustrates an overview of an example clustering-based unit-selection technique, in accordance with an embodiment. FIG. 1B describes another technique that uses a clustering method that may allow the target cost to be pre-calculated. Units of the same type may be clustered into a decision tree that depicts questions about features available at the time of synthesis. The cost functions may be formed from a variety of heuristic or ad hoc quality measures based on features of an acoustic signal and given texts, for which the acoustic signal is to be synthesized. In an example, target cost and concatenation cost functions based on statistical models can be used. Weights ($w_j^t$ and $w_k^c$) may be determined for each feature, and a combination of trained and manually-tuned weights can be used. In examples, these techniques may depend on an acoustic distance measure that can be correlated with human perception.

In an example, an optimal size (e.g., length of time) of units can be determined. The longer the unit, the larger the database may be to cover a given domain. In one example, short units (short pre-recorded waveforms) may offer more potential joining points than longer units. However, continuity can also be affected with more joining points. In another example, different-sized units, i.e., from frame-sized, half-phones, diphones, and non-uniform units can be used.

As an alternative to selection of actual instances of speech from a database, statistical parametric speech synthesis can be used to synthesize speech. Statistical parametric synthesis may be described as generating an average of sets of similarly sounding speech segments. This may contrast with the target of unit-selection synthesis, i.e., retaining natural unmodified speech units. Statistical parametric synthesis may include modeling spectral, prosody (rhythm, stress, and intonation of speech), and residual/excitation features. An example of statistical parametric synthesis is Hidden Markov Model (HMM)-based speech synthesis.

In an example statistical parametric speech synthesis system, parametric representations of speech including spectral and excitation parameters from a speech database can be extracted and then modeled using a set of generative models (e.g., HMMs). As an example, a maximum likelihood (ML) criterion can be used to estimate the model parameters as:

$$\hat{\lambda} = \underset{\lambda}{\operatorname{argmax}}\{p(O \mid W, \lambda)\} \quad \text{Equation (5)}$$

where λ is a set of model parameters, O is a set of training data, and W is a set of word sequences corresponding to O. Speech parameters o can then be generated for a given word sequence to be synthesized w, from the set of estimated models $\hat{\lambda}$, so as to maximize output probabilities as:

$$\hat{O} = \underset{o}{\operatorname{argmax}}\{p(o \mid w, \hat{\lambda})\} \quad \text{Equation (6)}$$

Then, a speech waveform can be constructed from the parametric representation of speech.

Figure 2:
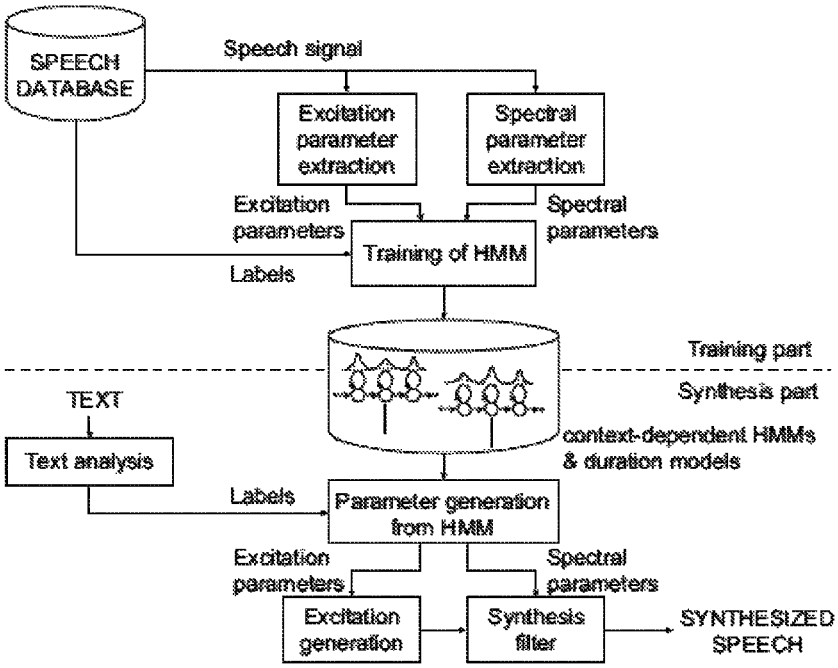
FIG. 2 illustrates block diagram of an example HMM-based speech synthesis system, in accordance with an embodiment.

FIG. 2 illustrates block diagram of an example HMM-based speech synthesis system, in accordance with an embodiment. The system in FIG. 2 includes a training portion and a synthesis portion. The training portion may be configured to perform the maximum likelihood estimation of Equation (5). In this manner, spectrum (e.g., mel-cepstral coefficients and dynamic features of the spectrum) and excitation (e.g., log F0 and dynamic features of the excitation) parameters can be extracted from a database of natural speech and modeled by a set of multi-stream context-dependent HMMs. In these examples, linguistic and prosodic contexts may be taken into account in addition to phonetic ones.

For example, the contexts used in an HMM-based synthesis system may include phoneme (current phoneme, preceding and succeeding two phonemes, and position of current phoneme within current syllable); syllable (number of phonemes within preceding, current, and succeeding syllables, stress and accent of preceding, current, and succeeding syllables, position of current syllable within current word and phrase, number of preceding and succeeding stressed syllables within current phrase, number of preceding and succeeding accented syllables within current phrase, number of syllables from previous stressed syllable, number of syllables to next stressed syllable, number of syllables from previous accented syllable, number of syllables to next accented syllable, and vowel identity within current syllable); word (guess at part of speech of preceding, current, and succeeding words, number of syllables within preceding, current, and succeeding words, position of current word within current phrase, number of preceding and succeeding content words within current phrase, number of words from previous content word, and number of words to next content word); phrase (number of syllables within preceding, current, and succeeding phrases, and position of current phrase in major phrases); and utterance (number of syllables, words, and phrases in utterance).

To model fixed-dimensional parameter sequences, such as mel-cepstral coefficients, single multi-variate Gaussian distributions can be used as stream-output distributions for the model. The HMM-based speech synthesis system, for example, may be configured to use multi-space probability distributions as stream output distributions. Each HMM may have a state-duration distribution to model temporal structure of speech. Choices for state-duration distributions may include Gaussian distribution and Gamma distribution. These distributions may be estimated from statistical variables obtained at a last iteration of a forward-backward algorithm, for example. Each of spectrum, excitation, and duration parameters may be clustered individually by phonetic decision trees because each of these parameters has respective context-dependency. As a result, the system may be configured to model the spectrum, excitation, and duration in a unified framework.

Contexts can be generated for a corpus of input speech, and linguistic features or contexts of the HMM can be clustered, or grouped together to form the decision trees. Clustering can simplify the decision trees by finding distinctions that readily group the input speech. In some examples, a "tied" or "clustered" decision tree can be generated that does not distinguish all features that make up full contexts for all phonemes; rather, a clustered decision tree may stop when a subset of features in the contexts can be identified.

A group of decision trees, perhaps including clustered decision trees, can form a "trained acoustic model" or "speaker-independent acoustic model" that uses likelihoods of training data to cluster the input speech and split the training data based on features in the contexts of the input speech. Each stream of information (pitch, duration, spectral, and aperiodicity) can have a separately trained decision tree in the trained acoustic model.

The synthesis portion may be configured to perform the maximization in Equation (6). Speech synthesis may be considered as an inverse operation of speech recognition. First, a given word sequence may be converted to a context dependent label sequence, and then an utterance HMM may be constructed by concatenating context-dependent HMMs according to the label sequence. Second, a speech parameter generation algorithm generates sequences of spectral and excitation parameters from the utterance HMM. Finally, a speech waveform may be synthesized from the generated spectral and excitation parameters via excitation generation and a speech synthesis filter, e.g., mel log spectrum approximation (MLSA) filter.

Figure 3:
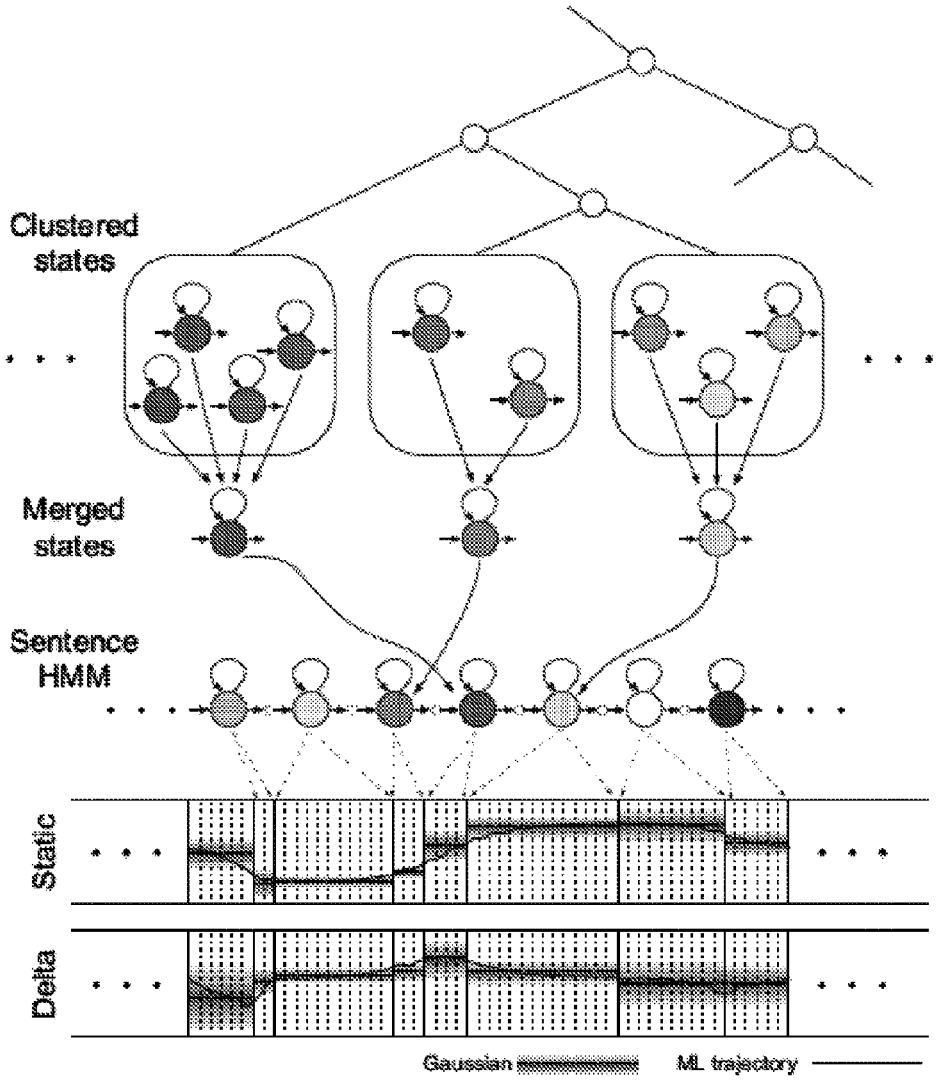
FIG. 3 illustrates an overview of an example HMM-based speech synthesis technique, in accordance with an embodiment.

FIG. 3 illustrates an overview of an example HMM-based speech synthesis technique, in accordance with an embodiment. In an example, each state-output distribution of the HMM may be considered as a single stream, single multivariate Gaussian distribution as:

$$b_j(o_t)=N(o_t;\mu_j,\tau_j) \quad \text{Equation (7)}$$

where $o_t$ is the state-output vector at frame t, $b_j(\bullet)$, $\mu_j$, and $\Sigma_j$ correspond to the j-th state-output distribution, mean vector, and covariance matrix of the distribution. Under the HMM-based speech synthesis framework, Equation (6) can be approximated as:

$$\hat{o} = \arg\max_{o}\{p(o \mid w, \hat{\lambda})\} \quad \text{Equation (8)}$$

$$= \arg\max_{o}\left\{\sum_{q} p(o, q \mid w, \hat{\lambda})\right\} \quad \text{Equation (9)}$$

$$\approx \arg\max_{o} \max_{q}\{p(o, q \mid w, \hat{\lambda})\} \quad \text{Equation (10)}$$

$$= \arg\max_{o} \max_{q}\{P(q \mid w, \hat{\lambda}) \cdot p(o \mid q, \hat{\lambda})\} \quad \text{Equation (11)}$$

$$\approx \arg\max_{o}\{p(o \mid \hat{q}, \hat{\lambda})\} \quad \text{Equation (12)}$$

$$= \arg\max_{o}\{N(o; \mu_{\hat{q}}, \Sigma_{\hat{q}})\} \quad \text{Equation (13)}$$

where $o=[o_1^T, \ldots, o_T^T]^T$ is a state-output vector sequence to be generated, $q=\{q_1, \ldots, q_T\}$ is a state sequence, $\mu_q=[\mu_{q1}^T, \ldots, \mu_{qT}^T]^T$ is the mean vector for q, $\Sigma_q=\mathrm{diag}[\Sigma_{q1}, \ldots, \Sigma_{qT}]$ is the covariance matrix for q, and T is the total number of frames in o. The state sequence $\hat{q}$ is determined so as to maximize state-duration probability of the state sequence as:

$$\hat{q} = \underset{q}{\mathrm{argmax}}\{P(q \mid w, \hat{\lambda})\} \quad \text{Equation (14)}$$

In this manner, $\hat{o}$ may be piece-wise stationary where a time segment corresponding to each state may adopt the mean vector of the state. However, speech parameters vary smoothly in real speech. In an example, to generate realistic speech parameter trajectory, the speech parameter generation algorithm may introduce relationships between static and dynamic features of speech as constraints for the maximization problem. As an example, the state-output vector, $o_t$, may comprise an M-dimensional static feature, $c_t$, and a first-order dynamic (delta) feature, $\Delta c_t$, as:

$$o_t=[c_t^T, \Delta c_t^T]^T \quad \text{Equation (15)}$$

and the dynamic feature $$\Delta c_t=c_t-c_{t-1} \quad \text{Equation (16)}$$

In this example, the relationship between $o_f$ and $c_t$ can be arranged in a matrix form as:

$$\begin{bmatrix} \overset{o}{\vdots} \\ c_{t-1} \\ \Delta c_{t-1} \\ c_t \\ \Delta c_t \\ c_{t+1} \\ \Delta c_{t+1} \\ \vdots \end{bmatrix} = \overset{W}{\begin{bmatrix} \ldots & \vdots & \vdots & \vdots & \vdots & \ldots \\ \ldots & 0 & I & 0 & 0 & \ldots \\ \ldots & -I & I & 0 & 0 & \ldots \\ \ldots & 0 & 0 & I & 0 & \ldots \\ \ldots & 0 & -I & I & 0 & \ldots \\ \ldots & 0 & 0 & 0 & I & \ldots \\ \ldots & 0 & 0 & -I & I & \ldots \\ \ldots & \vdots & \vdots & \vdots & \vdots & \ldots \end{bmatrix}} \begin{bmatrix} \overset{c}{\vdots} \\ c_{t-2} \\ c_{t-1} \\ c_t \\ c_{t+1} \\ \vdots \end{bmatrix} \quad \text{Equation (17)}$$

where $c=[c_1^T, \ldots c_T^T]^T$ a static feature vector sequence and W is a matrix, which may append dynamic features to c. I and 0 correspond to the identity and zero matrices.

The state-output vectors thus may be considered as a linear transform of the static features. Therefore, maximizing N(o; $\mu_{\hat{q}}, \Sigma_{\hat{q}}$) with respect to o may be equivalent to that with respect to c:

$$\hat{c} = \underset{c}{\operatorname{argmax}}\{N(Wc; \mu_{\hat{q}}, \Sigma_{\hat{q}})\} \quad \text{Equation (18)}$$

By equating $$\frac{\partial N(Wc; \mu_{\hat{q}}, \Sigma_{\hat{q}})}{\partial c} \text{ to } 0,$$

a set of linear equations to determines can be obtained as:

$$W^T\Sigma_{\hat{q}}^{-1}W\hat{c} = W^T\Sigma_{\hat{q}}^{-1}\mu_{\hat{q}} \quad \text{Equation (19)}$$

Because $W^T\Sigma_{\hat{q}}^{-1}W$ has a positive definite band-symmetric structure, the linear equations can be solved in a computationally efficient manner. In this example, the trajectory of $\hat{c}$ may not be piece-wise stationary, since associated dynamic features also contribute to the likelihood, and may be consistent with the HMM parameters. FIG. 3 shows the effect of dynamic feature constraints; the trajectory of c may become smooth (delta) rather than piece-wise (static)

The ML method is used as an example illustration only. Methods other than ML can be used; for example, a recursive a-posteriori-based traversal algorithm, such as the Constrained Structural Maximum a Posteriori Linear Regression (CSMAPLR) algorithm, which uses piece-wise linear regression functions to estimate paths to leaf nodes of a decision tree, can be used. Other examples are possible as well.

Statistical parametric synthesis can be used to account for changing voice characteristics, speaking styles, emotions, and characteristics of an environment. In examples, the term 'environment' may refer to an auditory or acoustic environment where a device resides, and may represent a combination of sounds originating from several sources, propagating, reflecting upon objects and affecting an audio capture device (e.g., a microphone) or a listener's ear.

As an example, a speech synthesis system may be configured to mimic Lombard effect or Lombard reflex, which includes an involuntary tendency of a speaker to increase vocal effort when speaking in generally loud or altered noise to enhance intelligibility of voice of the speaker. The increase in vocal effort may include an increase in loudness as well as other changes in acoustic features such as pitch and rate, duration of sound syllables, spectral tilt, formant positions, etc. These adjustments or changes may result in an increase in auditory signal-to-noise ratio of words spoken by the speaker (or speech output by the speech system), and thus make the words intelligible.

As an example, a device that includes a text-to-speech (TTS) module may be configured to determine characteristics of an environment of the device (e.g., characteristics of background sound in the environment). The device also may be configured to determine, based on the one or more characteristics of the environment, speech parameters of an HMM-based speech model that characterizes a voice output of the text-to-speech module. Further, the device may be configured to process a text to obtain the voice output corresponding to the text based on the speech parameters to account for the characteristics of the environment (e.g., mimic Lombard reflex).

Figure 4:
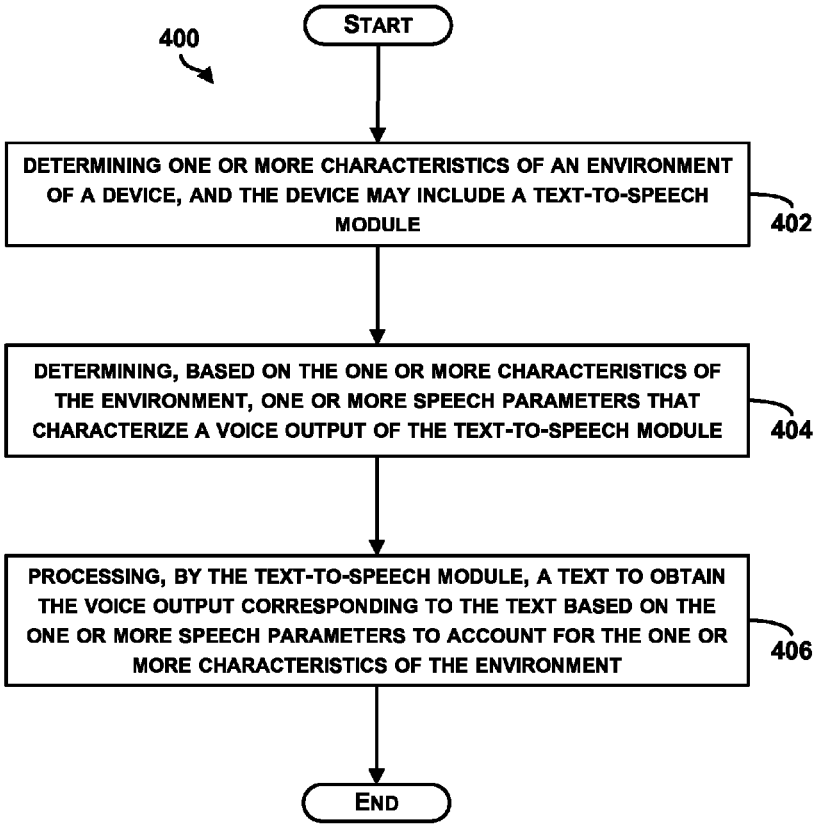
FIG. 4 is a flowchart of an example method for adaptation of synthetic speech in an environment, in accordance with an embodiment.

FIG. 4 illustrates a flowchart of an example method 400 for adaptation of synthetic speech in an environment, in accordance with an embodiment.

The method 400 may include one or more operations, functions, or actions as illustrated by one or more of blocks 402-406. Although the blocks are illustrated in a sequential order, these blocks may in some instances be performed in parallel, and/or in a different order than those described herein. Also, the various blocks may be combined into fewer blocks, divided into additional blocks, and/or removed based upon the desired implementation In addition, for the method 400 and other processes and methods disclosed herein, the flowchart shows functionality and operation of one possible implementation of present examples. In this regard, each block may represent a module, a segment, or a portion of program code, which includes one or more instructions executable by a processor for implementing specific logical functions or steps in the process. The program code may be stored on any type of computer readable medium or memory, for example, such as a storage device including a disk or hard drive. The computer readable medium may include a non-transitory computer readable medium or memory, for example, such as computer-readable media that stores data for short periods of time like register memory, processor cache and Random Access Memory (RAM). The computer readable medium may also include non-transitory media or memory, such as secondary or persistent long term storage, like read only memory (ROM), optical or magnetic disks, compact-disc read only memory (CD-ROM), for example. The computer readable media may also be any other volatile or non-volatile storage systems. The computer readable medium may be considered a computer readable storage medium, a tangible storage device, or other article of manufacture, for example.

In addition, for the method 400 and other processes and methods disclosed herein, each block in FIG. 4 may represent circuitry that is wired to perform the specific logical functions in the process.

At block 402, the method 400 includes determining one or more characteristics of an environment of a device, and the device may include a text-to-speech module. The device can be, for example, a mobile telephone, personal digital assistant (PDA), laptop, notebook, or netbook computer, tablet computing device, a wearable computing device, etc. The device may be configured to include a text-to-speech (TTS) module to convert text into speech to facilitate interaction of a user with the device, for example. As an example, a user of a mobile phone may be driving, and the mobile phone may be configured to cause the TTS module to speak out text displayed on the mobile phone to the user in order to allow interaction with the user without the user being distracted by looking at the displayed text. In another example, the user may have limited sight, and the mobile phone may be configured to convert text related to functionality of various software applications of the mobile phone to voice to facilitate interaction of the user with the mobile phone. These examples are for illustration only. Other examples for use of the TTS module are possible.

In an example, the TTS module may include and be configured to execute software (e.g., speech synthesis algorithm) as well as include hardware components (e.g., memory configured to store instructions, a speaker, etc.). In examples, the TTS module may include two portions: a front-end portion and a back-end portion. The front-end portion may have two tasks; first, the front end portion may be configured to convert raw text containing symbols like numbers and abbreviations into equivalent written-out words. This process may be referred to as text normalization, pre-processing, or tokenization. The front-end portion also may be configured to assign phonetic transcriptions to each word, and divide and mark the text into prosodic units, such as phrases, clauses, and sentences. The process of assigning phonetic transcriptions to words may be referred to as text-to-phoneme or grapheme-to-phoneme conversion. Phonetic transcriptions and prosody information together may make up a symbolic linguistic representation that is output by the front-end portion. The back-end portion, referred to as synthesizer, may be configured to convert the symbolic linguistic representation into sound. In some examples, this part may include computation of a target prosody (pitch contour, phoneme durations), which may then be imposed on output speech.

The device may include a processor in communication with the device and the TTS module. In one example, the processor may be included in the device; however, in another example, the device may be coupled to a remote server (e.g., cloud-based server) that is in wired/wireless communication with the device and processing functions may be performed by the server. Also, in examples, functionality of the TTS module may be performed in the device or remotely at a server or may be divided between both the device and a remote server. The device may be configured to determine characteristics of an environment of the device. As examples, the device may include sensors (cameras, microphones, etc.) that can receive information about the environment of the device. The device may be configured to determine numerical parameters, based on the information received from the sensors, to determine characteristics of the environment. For example, the device may include an audio capture unit (e.g., the device may be a mobile phone including a microphone) that may be configured to capture an audio signal from the environment. The audio signal may be indicative of characteristics of a background sound in the environment of the device, for example.

In an example, the processor may be configured to analyze the audio signal, and determine signal parameters to infer noise level in the environment. For instance, the processor may be configured to determine an absolute measurement of noise (e.g., in Decibels) in the environment. In another example, the processor may be configured to determine a signal-to-noise ratio (SNR) between noise in the environment and a synthesized TTS signal.

In still another example, the processor may be configured to determine a type of noise in the environment (e.g., car noise, office noise, another speaker talking, singing, etc.) based on the audio signal. In examples, determining noise type may comprise two stages: a training stage and an estimation stage. In the training stage, a training computing device may be configured to have access to data sets corresponding to different types of noise (white noise, bubble noise, car noise, airplane noise, party nose, crowd cheers, etc.) The training computing device may be configured to extract a spectral envelop features (e.g., AutoRegressive Coefficients, Line-Spectrum-Pairs, Line-Spectrum-Frequencies, cepstrum coefficient, etc.) for each data set; and may be configured to train a Gaussian Mixture Model (GMM) using the features of each data set. Thus, for each data set, a corresponding GMM may be determined. In the estimation stage, the processor of the device present in a given environment may be configured to extract respective spectral envelop features from the audio signal captured from the given environment; and may be configured to utilize a maximum likelihood classifier to determine which GMM represents the respective spectral envelop features extracted from the audio signal, and thus determine the type of noise in the given environment.

The examples above describe using numerical parameters (e.g., SNR) to represent characteristics of the given environment; however, in other examples, qualitative or discrete labels such as "high," "low," "car," "office," etc., can be used as well. In these examples, in the estimation stage, a classifier, such as GMM, a support vector machine (SVM), a neural network, etc., can be used to match characteristics of the audio signal of the given environment to the qualitative labels and thus determine characteristics of noise in the given environment (e.g., noise level is "high," "medium," or "low" and type of noise is "car," "office," etc.).

At block 404, the method 400 includes determining, based on the one or more characteristics of the environment, one or more speech parameters that characterize a voice output of the text-to-speech module. As an example, based on the characteristics of the environment, the processor may be configured to determine the speech parameters for a statistical parametric model (e.g., HMM-based model) that characterizes a synthesized speech signal output of the TTS module in order to account for or adapt to the characteristics (e.g., background noise) of the environment. Thus, the processor, using the speech parameters determined based on the characteristics of the environment, can cause speech output of the TTS module intelligible in the environment of the device.

As an example, speech parameters for a given environment may be predetermined and stored in a memory coupled to the device. The processor may be configured to cause the TTS module to transform the stored speech parameters into modified speech parameters adapted to a different environment (e.g., a current environment of the device that is different from the given environment).

In another example, the device may be configured to store or have access to a first set of speech parameters that have been determined, e.g., using an HMM-based statistical synthesis model, for a substantially background sound-free environment. Also, the device may be configured to store or have access to a second set of speech parameters determined for a given environment with a predetermined background sound condition, i.e., a voice output or speech signal generated by the TTS module using the second set of speech parameters may be intelligible in the predetermined background sound condition (i.e., mimics Lombard effect in the predetermined background sound condition). In this example, the processor may be configured to use the first set of speech parameters and the second set of speech parameters to determine speech parameters adapted to another environmental condition.

In one example, the processor may be configured to determine the speech parameters by extrapolating or interpolating between the first set of speech parameters and the second set of speech parameters. Interpolation (or extrapolation) may enable synthesizing speech that is intelligible in a current environment of the device using speech parameters that were determined for different environments with different characteristics.

As an example for illustration, speech parameters can be determined for three noise levels: substantially noise-free, moderate noise, and extreme noise. Averaged A-weighted sound pressure levels, for example, can be selected to be about 65 dB for moderate and about 72 dB for extreme noise, and average SNRs can be selected to be about −1 dB and about −8 dB for moderate and extreme noises, respectively. These numbers are examples for illustration only. Other examples are possible. Speech samples can be recorded in these three conditions and respective HMM-based speech models or speech parameters can be generated that make a respective voice output of a TTS module intelligible in the respective noise level. The speech parameters can be stored in a memory coupled to the processor. The processor may be configured to interpolate (or extrapolate) using the stored speech parameters determined for the three noise levels to determine speech parameters for a different noise level of a current environment of the device. In the example where a numerical parameter, such as SNR, is determined for the current environment of the device, the numerical parameter can be used to define an interpolation weight between the stored speech parameters determined for three noise levels.

Figure 5:
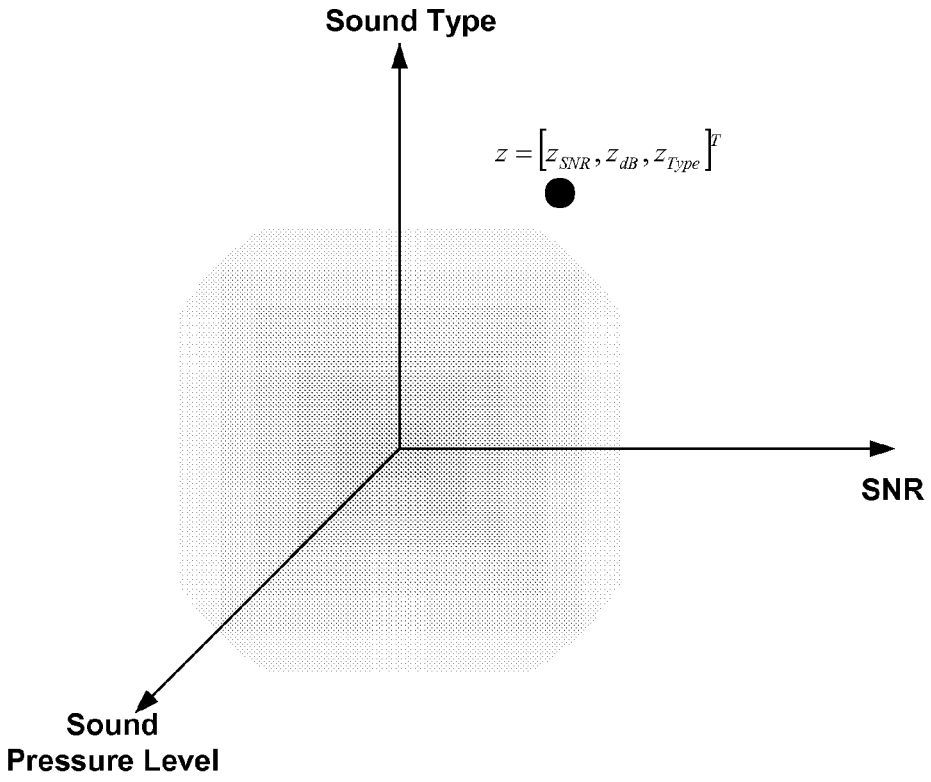
FIG. 5 illustrates an example environment space, in accordance with an embodiment.

FIG. 5 illustrates an example environment space, in accordance with an embodiment. The example environment space may be defined by three variables: signal-to-noise ratio (SNR), noise type (e.g., car noise, song, etc.), and sound pressure level in dB. These variables are for illustration only, and other variables can be used to define an environment. The noise type can be qualitative or can be characterized by numerical values of parameters indicative of the noise type. A vector 'z' can be determined for a given environment, and can be used for interpolation among sets of speech parameters determined for other 'z' vectors representing other environments, for example.

In another example, in addition to or alternative to interpolation (or extrapolation), the processor may be configured to determine a transform to convert the first set of speech parameters to the second set of speech parameters. The processor also may be configured to modify, based on the characteristics of a current environment of the device, the transform; and apply the modified transform to the first set of speech parameters or the second the second set of speech parameters to obtain the speech parameters for the current environment of the device.

In one example, the processor may be configured to determine the speech parameters in real time. In this example, the processor may be configured to determine time-varying characteristics of an environment in real time, and also determine time varying speech parameters that adapt to the changing characteristics of the environment in real time. To illustrate this example, a user may be at a party and may be using a mobile phone or a wearable computing device. The mobile phone or wearable computing device may include a microphone configured to continuously capture audio signals indicative of background sound that may be changing overtime (e.g., gradual increase in background noise loudness, different songs being played with different sound characteristics, etc.). Accordingly, the processor may be configured to continuously update, based on the changing characteristics of the environment, the speech parameters used by the TTS to generate the voice output at the mobile phone such that the voice output may remain intelligible despite the changing background sound.

In other examples, the device may be configured to store sets of parameters determined for different environmental conditions, and the processor may be configured to select a given set of the stored sets of speech parameters based on the characteristics of the environment. Other examples are possible.

Referring back to FIG. 4, at block 406, the method 400 includes processing, by the text-to-speech module, a text to obtain the voice output corresponding to the text based on the one or more speech parameters to account for the one or more characteristics of the environment. As used herein, to account for a characteristic of the environment means to adjust the output of the text-to-speech module so that attributes of the output (speech) are at desired levels, such as volume, pitch, rate and duration of syllables, and so forth. As described above at block 402, the TTS module may be configured to convert text into speech by preprocessing the text, assigning phonetic transcriptions to each word, dividing and marking the text into prosodic units, like phrases, clauses, and sentences; and then the TTS module may be configured to convert symbolic linguistic representation of a text into sound. The TTS may thus be configured to generate or synthesize a speech waveform that corresponds to the text.

Figure 6:
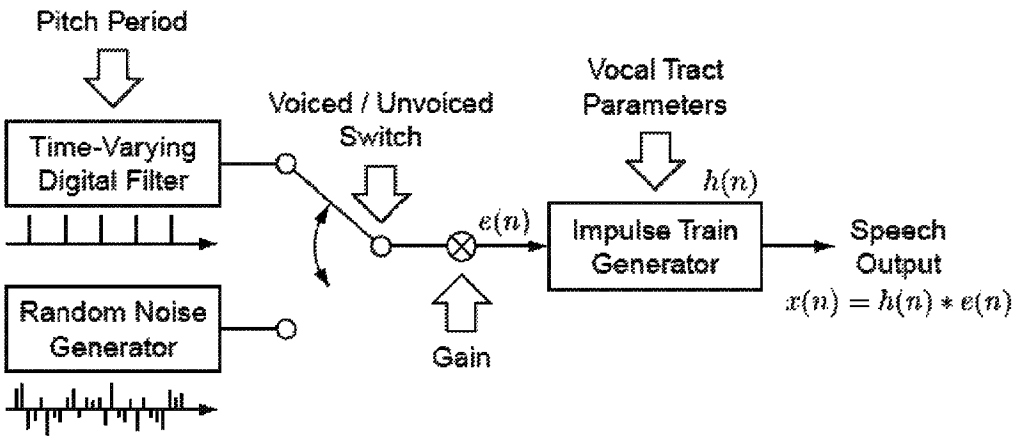
FIG. 6 illustrates an example system for generating a speech waveform, in accordance with an embodiment.

FIG. 6 illustrates an example system for generating the speech waveform, in accordance with an embodiment. The speech waveform can be described mathematically by a discrete-time model that represents sampled speech signals, as shown in FIG. 6. The TTS module may be configured to utilize the speech parameters determined to generate a transfer function H(z) that models structure of vocal tract. Excitation source may be chosen by a switch which may be configured to control voiced/unvoiced characteristics of speech. An excitation signal can be modeled as either a quasi-periodic train of pulses for voiced speech, or a random noise sequence for unvoiced sounds. Speech parameters of the speech model may change with time to produce speech signals x(n). In an example, general properties of the vocal tract and excitation may remain fixed for periods of 5-10 msec. In this example, the excitation e(n) may be filtered by a slowly time-varying linear system H(z) to generate speech signals x(n). The speech x(n) can be computed from the excitation e(n) and impulse response h(n) of the vocal tract using the convolution sum expression:

$$x(n)=h(n)*e(n) \qquad \text{Equation (20)}$$

where the symbol * stands for discrete convolution.

Other digital signal processing and speech processing techniques can be used by the TTS module to generate the speech waveform using the speech parameters. The processor may be configured to cause the speech waveform or voice output corresponding to the text to be played through a speaker coupled to the device, for example.

Although the method 400 is described in the context of using statistical synthesis methods, such as HMM-based speech models, the method 400 can be used with concatenative (i.e., unit-selection) techniques as well. As described above, unit-selection synthesis uses large databases of recorded speech. During database creation, each recorded utterance is segmented into some or all of the following: individual phones, diphones, half-phones, syllables, morphemes, words, phrases, and sentences. Division into segments may be done, for example, using a modified speech recognizer set to a "forced alignment" mode with manual correction afterward, using visual representations such as the waveform and a spectrogram. An index of the units in the speech database can then be created based on the segmentation and acoustic parameters like fundamental frequency (pitch), duration, position in the syllable, and neighboring phones. At run time, a desired target utterance is created by determining a chain of candidate units from the database (unit-selection) that meets certain criteria (e.g., optimization of target cost and concatenation cost).

In an example, the processor may be configured to synthesize (by unit-selection) a voice signal using speech waveforms pre-recorded in a given environment having predetermined characteristics such as predetermined background sound characteristics (e.g., a substantially background sound-free environment). The processor may be configured then to modify, using the speech parameters determined at block 404 of the method 400, the synthesized voice signal to obtain the voice output of the text that is intelligible in a current environment of the device. For example, the processor may be configured to scale, based on the speech parameters, signal parameters of the synthesized voice signal by a factor (e.g., volume×1.2, duration×1.3, frequency×0.8 etc). In this example, the voice output may differ from the synthesized voice signal in one or more of volume, duration, pitch, and spectrum to account for the characteristics of the current environment of the device.

In another example, the processor may be configured to utilize a Pitch Synchronous Overlap Add (PSOLA) method to generate the voice output by modifying, based on the speech parameters determined for the environment of the device, the pitch and duration of the synthesized voice signal. Using PSOLA, the processor may be configured to divide the synthesized voice signal waveform in small overlapping segments. To change the pitch of the signal, the segments may be moved further apart (to decrease the pitch) or closer together (to increase the pitch). To change the duration of the signal, the segments may then be repeated multiple times (to increase the duration) or some segments are eliminated (to decrease the duration). The segments may then be combined using the overlap add technique known in the art. PSOLA can thus be used to change the prosody of the synthesized voice signal.

In an example that combines unit-selection method with the statistical modeling method, the processor may be configured to determine a transform for each state of an HMM-based speech model; the transform may include an estimation of spectral and prosodic parameters that may cause the voice output to be intelligible in the environment of the device. Also, the processor may be configured to synthesize a speech signal using unit-selection (concatenative method) from a database that includes waveforms pre-recorded in a background sound-free environment. This synthesized speech signal can be referred to as a modal speech signal. The modal speech signal may be split into a plurality of frames, each frame with a predetermined length of time (e.g., 5 ms per frame). For each frame, the processor may be configured to identify a corresponding HMM state, and further identify a corresponding transform for the corresponding HMM state; thus, the processor may be configured to determine a sequence of transforms, one for each speech frame. In one example, the processor may be configured to apply a low-pass smoothing filter to the sequence of transforms over time to avoid rapid variations that may introduce artifacts in the voice output. The processor may be configured to apply the transforms to spectral envelopes and prosody of the modal speech signal by means of non-stationary filtering and PSOLA to synthesize a speech signal that is intelligible in the environment of the device.

Figure 7:
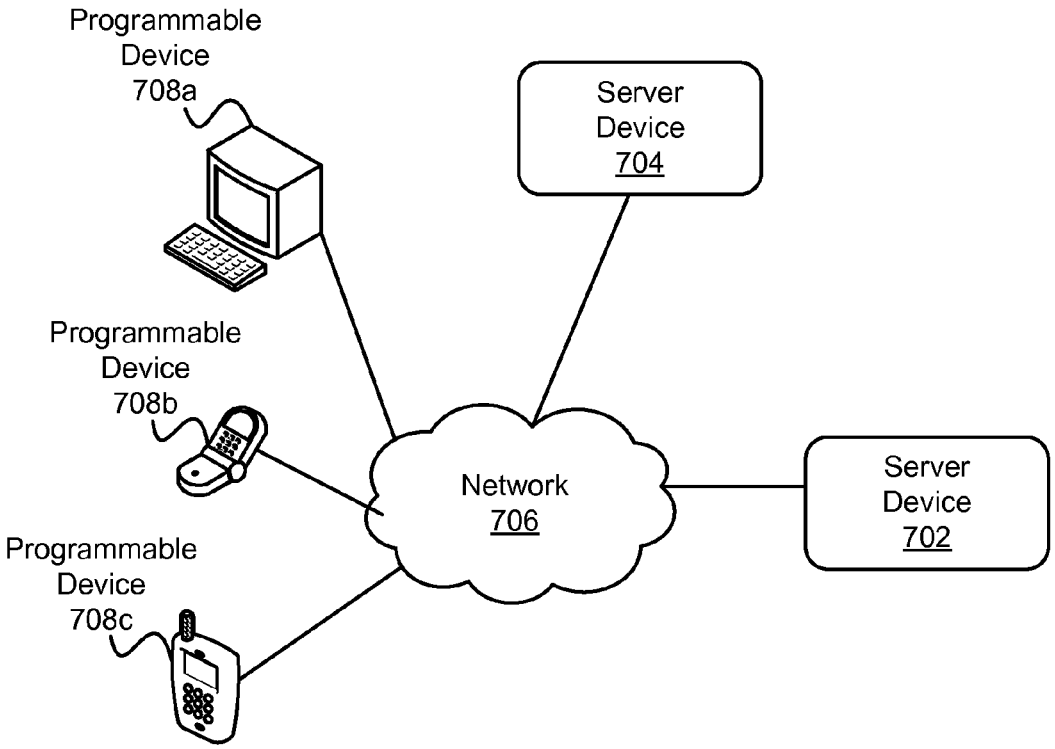
FIG. 7 illustrates an example distributed computing architecture, in accordance with an example embodiment.

FIG. 7 illustrates an example distributed computing architecture, in accordance with an example embodiment. FIG. 7 shows server devices 702 and 704 configured to communicate, via network 706, with programmable devices 708*a*, 708*b*, and 708*c*. The network 706 may correspond to a LAN, a wide area network (WAN), a corporate intranet, the public Internet, or any other type of network configured to provide a communications path between networked computing devices. The network 706 may also correspond to a combination of one or more LANs, WANs, corporate intranets, and/or the public Internet.

Although FIG. 7 shows three programmable devices, distributed application architectures may serve tens, hundreds, or thousands of programmable devices. Moreover, the programmable devices 708*a*, 708*b*, and 708*c* (or any additional programmable devices) may be any sort of computing device, such as an ordinary laptop computer, desktop computer, network terminal, wireless communication device (e.g., a tablet, a cell phone or smart phone, a wearable computing device, etc.), and so on. In some examples, the programmable devices 708*a*, 708*b*, and 708*c* may be dedicated to the design and use of software applications. In other examples, the programmable devices 708*a*, 708*b*, and 708*c* may be general purpose computers that are configured to perform a number of tasks and may not be dedicated to software development tools.

The server devices 702 and 704 can be configured to perform one or more services, as requested by programmable devices 708*a*, 708*b*, and/or 708*c*. For example, server device 702 and/or 704 can provide content to the programmable devices 708*a*-708*c*. The content can include, but is not limited to, web pages, hypertext, scripts, binary data such as compiled software, images, audio (e.g., synthesized text-to-speech signal), and/or video. The content can include compressed and/or uncompressed content. The content can be encrypted and/or unencrypted. Other types of content are possible as well.

As another example, the server device 702 and/or 704 can provide the programmable devices 708*a*-708*c* with access to software for database, search, computation, graphical, audio (e.g. speech synthesis), video, World Wide Web/Internet utilization, and/or other functions. Many other examples of server devices are possible as well.

The server devices 702 and/or 704 can be cloud-based devices that store program logic and/or data of cloud-based applications and/or services. In some examples, the server devices 702 and/or 704 can be a single computing device residing in a single computing center. In other examples, the server device 702 and/or 704 can include multiple computing devices in a single computing center, or multiple computing devices located in multiple computing centers in diverse geographic locations. For example, FIG. 7 depicts each of the server devices 702 and 704 residing in different physical locations.

In some examples, data and services at the server devices 702 and/or 704 can be encoded as computer readable information stored in non-transitory, tangible computer readable media (or computer readable storage media) and accessible by programmable devices 708*a*, 708*b*, and 708*c*, and/or other computing devices. In some examples, data at the server device 702 and/or 704 can be stored on a single disk drive or other tangible storage media, or can be implemented on multiple disk drives or other tangible storage media located at one or more diverse geographic locations.

Figure 8A:
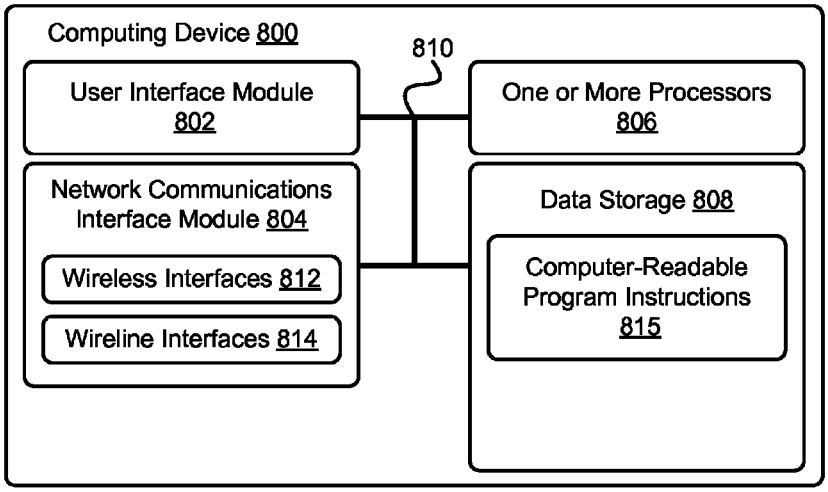
FIG. 8A is a block diagram of an example computing device, in accordance with an example embodiment illustrates.

FIG. 8A is a block diagram of a computing device (e.g., system) in accordance with an example embodiment. In particular, computing device 800 shown in FIG. 8A can be configured to perform one or more functions of the server devices 702, 704, network 706, and/or one or more of the programmable devices 708*a*, 708*b*, and 708*c*. The computing device 800 may include a user interface module 802, a network communications interface module 804, one or more processors 806, and data storage 808, all of which may be linked together via a system bus, network, or other connection mechanism 810.

The user interface module 802 can be operable to send data to and/or receive data from external user input/output devices. For example, user interface module 802 can be configured to send and/or receive data to and/or from user input devices such as a keyboard, a keypad, a touch screen, a computer mouse, a track ball, a joystick, a camera, a voice recognition/synthesis module, and/or other similar devices. The user interface module 802 can also be configured to provide output to user display devices, such as one or more cathode ray tubes (CRT), liquid crystal displays (LCD), light emitting diodes (LEDs), displays using digital light processing (DLP) technology, printers, light bulbs, and/or other similar devices, either now known or later developed. The user interface module 802 can also be configured to generate audible output(s)

(e.g., synthesized speech), and may include a speaker, speaker jack, audio output port, audio output device, earphones, and/or other similar devices.

The network communications interface module 804 can include one or more wireless interfaces 812 and/or one or more wireline interfaces 814 that are configurable to communicate via a network, such as network 706 shown in FIG. 7. The wireless interfaces 812 can include one or more wireless transmitters, receivers, and/or transceivers, such as a Bluetooth transceiver, a Zigbee transceiver, a Wi-Fi transceiver, a LTE transceiver, and/or other similar type of wireless transceiver configurable to communicate via a wireless network. The wireline interfaces 814 can include one or more wireline transmitters, receivers, and/or transceivers, such as an Ethernet transceiver, a Universal Serial Bus (USB) transceiver, or similar transceiver configurable to communicate via a twisted pair wire, a coaxial cable, a fiber-optic link, or a similar physical connection to a wireline network.

In some examples, the network communications interface module 804 can be configured to provide reliable, secured, and/or authenticated communications. For each communication described herein, information for ensuring reliable communications (i.e., guaranteed message delivery) can be provided, perhaps as part of a message header and/or footer (e.g., packet/message sequencing information, encapsulation header(s) and/or footer(s), size/time information, and transmission verification information such as CRC and/or parity check values). Communications can be made secure (e.g., be encoded or encrypted) and/or decrypted/decoded using one or more cryptographic protocols and/or algorithms, such as, but not limited to, DES, AES, RSA, Diffie-Hellman, and/or DSA. Other cryptographic protocols and/or algorithms can be used as well or in addition to those listed herein to secure (and then decrypt/decode) communications.

The processors 806 can include one or more general purpose processors and/or one or more special purpose processors (e.g., digital signal processors, application specific integrated circuits, etc.). The processors 806 can be configured to execute computer-readable program instructions 815 that are contained in the data storage 808 and/or other instructions as described herein (e.g., the method 400).

The data storage 808 can include one or more computer-readable storage media that can be read and/or accessed by at least one of processors 806. The one or more computer-readable storage media can include volatile and/or non-volatile storage components, such as optical, magnetic, organic or other memory or disc storage, which can be integrated in whole or in part with at least one of the processors 806. In some examples, the data storage 808 can be implemented using a single physical device (e.g., one optical, magnetic, organic or other memory or disc storage unit), while in other examples, the data storage 808 can be implemented using two or more physical devices.

The data storage 808 can include computer-readable program instructions 815 and perhaps additional data, such as but not limited to data used by one or more processes and/or threads of a software application. In some examples, data storage 808 can additionally include storage required to perform at least part of the herein-described methods (e.g., the method 400) and techniques and/or at least part of the functionality of the herein-described devices and networks.

Figure 8B:
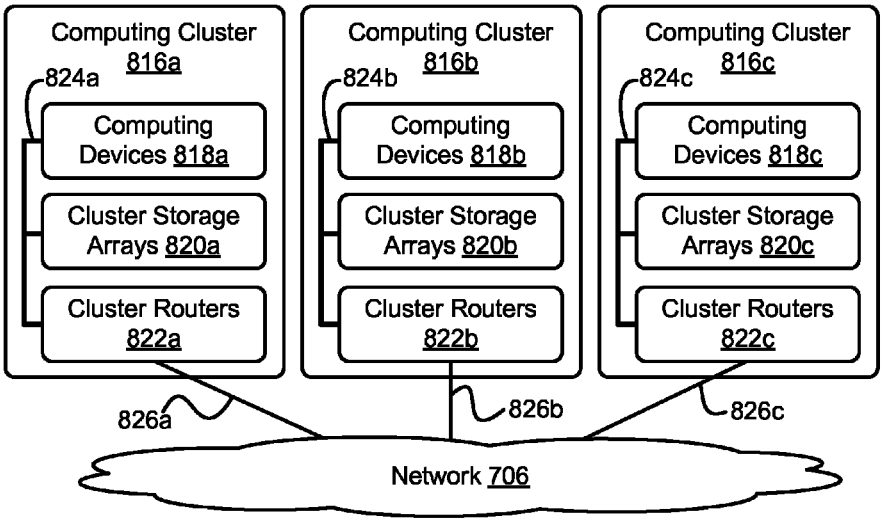
FIG. 8B illustrates a cloud-based server system, in accordance with an example embodiment.

FIG. 8B depicts a cloud-based server system, in accordance with an example embodiment. In FIG. 8B, functions of the server device 702 and/or 704 can be distributed among three computing clusters 816*a*, 816*b*, and 816*c*. The computing cluster 816*a* can include one or more computing devices 818*a*, cluster storage arrays 820*a*, and cluster routers 822*a* connected by a local cluster network 824*a*. Similarly, the computing cluster 816*b* can include one or more computing devices 818*b*, cluster storage arrays 820*b*, and cluster routers 822*b* connected by a local cluster network 824*b*. Likewise, computing cluster 816*c* can include one or more computing devices 818*c*, cluster storage arrays 820*c*, and cluster routers 822*c* connected by a local cluster network 824*c*.

In some examples, each of the computing clusters 816*a*, 816*b*, and 816*c* can have an equal number of computing devices, an equal number of cluster storage arrays, and an equal number of cluster routers. In other examples, however, each computing cluster can have different numbers of computing devices, different numbers of cluster storage arrays, and different numbers of cluster routers. The number of computing devices, cluster storage arrays, and cluster routers in each computing cluster can depend on the computing task or tasks assigned to each computing cluster.

In the computing cluster 816*a*, for example, the computing devices 818*a* can be configured to perform various computing tasks of the server device 702. In one example, the various functionalities of the server device 702 can be distributed among one or more of computing devices 818*a*, 818*b*, and 818*c*. The computing devices 818*b* and 818*c* in the computing clusters 816*b* and 816*c* can be configured similarly to the computing devices 818*a* in computing cluster 816*a*. On the other hand, in some examples, the computing devices 818*a*, 818*b*, and 818*c* can be configured to perform different functions.

In some examples, computing tasks and stored data associated with server devices 702 and/or 704 can be distributed across computing devices 818*a*, 818*b*, and 818*c* based at least in part on the processing requirements of the server devices 702 and/or 704, the processing capabilities of computing devices 818*a*, 818*b*, and 818*c*, the latency of the network links between the computing devices in each computing cluster and between the computing clusters themselves, and/or other factors that can contribute to the cost, speed, fault-tolerance, resiliency, efficiency, and/or other design goals of the overall system architecture.

The cluster storage arrays 820*a*, 820*b*, and 820*c* of the computing clusters 816*a*, 816*b*, and 816*c* can be data storage arrays that include disk array controllers configured to manage read and write access to groups of hard disk drives. The disk array controllers, alone or in conjunction with their respective computing devices, can also be configured to manage backup or redundant copies of the data stored in the cluster storage arrays to protect against disk drive or other cluster storage array failures and/or network failures that prevent one or more computing devices from accessing one or more cluster storage arrays.

Similar to the manner in which the functions of the server devices 702 and/or 704 can be distributed across computing devices 818*a*, 818*b*, and 818*c* of computing clusters 816*a*, 816*b*, and 816*c*, various active portions and/or backup portions of these components can be distributed across cluster storage arrays 820*a*, 820*b*, and 820*c*. For example, some cluster storage arrays can be configured to store the data of the server device 702, while other cluster storage arrays can store data of the server device 704. Additionally, some cluster storage arrays can be configured to store backup versions of data stored in other cluster storage arrays.

The cluster routers 822*a*, 822*b*, and 822*c* in computing clusters 816*a*, 816*b*, and 816*c* can include networking equipment configured to provide internal and external communications for the computing clusters. For example, the cluster routers 822*a* in computing cluster 816*a* can include one or more internet switching and routing devices configured to provide (i) local area network communications between the computing devices 818*a* and the cluster storage arrays 820*a* via the local cluster network 824*a*, and (ii) wide area network communications between the computing cluster 816*a* and the computing clusters 816*b* and 816*c* via the wide area network connection 826*a* to network 706. The cluster routers 822*b* and 822*c* can include network equipment similar to the cluster routers 822*a*, and the cluster routers 822*b* and 822*c* can perform similar networking functions for the computing clusters 816*b* and 816*c* that the cluster routers 822*a* perform for the computing cluster 816*a*.

In some examples, the configuration of the cluster routers 822*a*, 822*b*, and 822*c* can be based at least in part on the data communication requirements of the computing devices and cluster storage arrays, the data communications capabilities of the network equipment in the cluster routers 822*a*, 822*b*, and 822*c*, the latency and throughput of the local networks 824*a*, 824*b*, 824*c*, the latency, throughput, and cost of wide area network links 826*a*, 826*b*, and 826*c*, and/or other factors that can contribute to the cost, speed, fault-tolerance, resiliency, efficiency and/or other design goals of the moderation system architecture.

Figure 9:
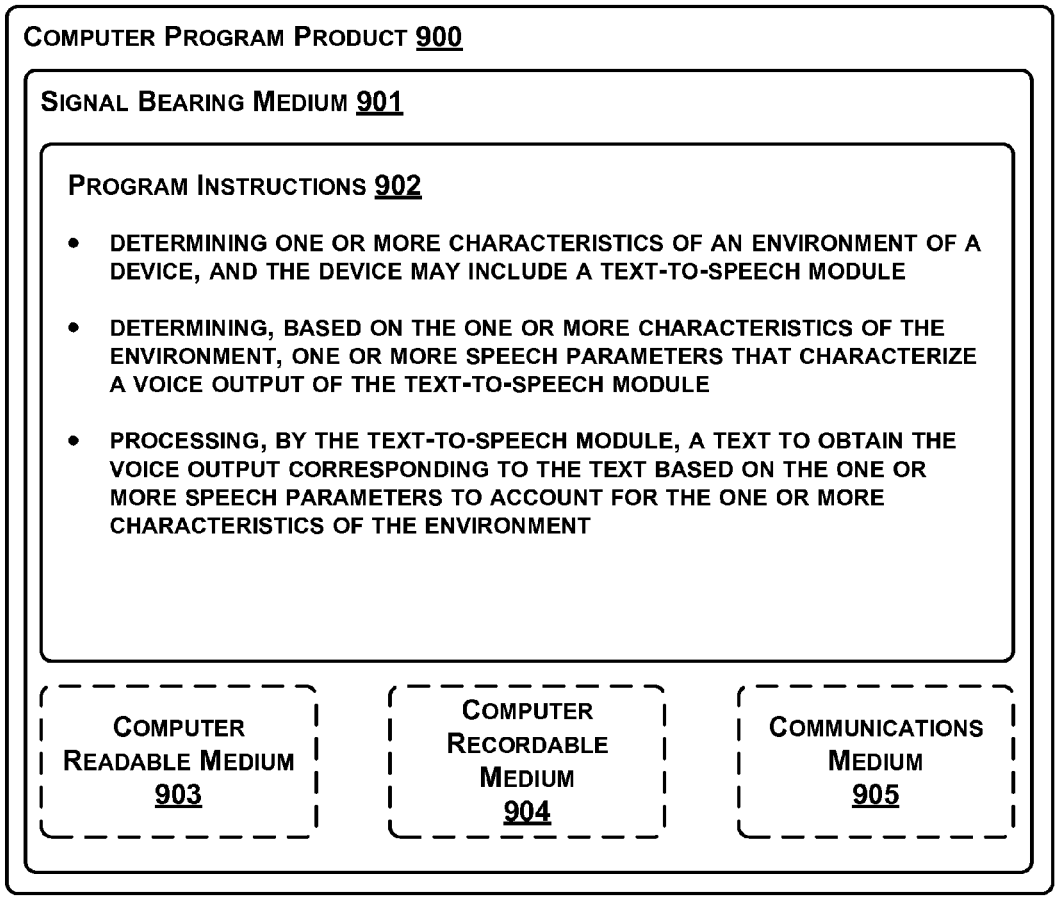
FIG. 9 is a schematic illustrating a conceptual partial view of an example computer program product that includes a computer program for executing a computer process on a computing device, arranged according to at least some embodiments presented herein.

In some examples, the disclosed methods (e.g., the method 400) may be implemented as computer program instructions encoded on a non-transitory computer-readable storage media in a machine-readable format, or on other non-transitory media or articles of manufacture. FIG. 9 is a schematic illustrating a conceptual partial view of an example computer program product that includes a computer program for executing a computer process on a computing device, arranged according to at least some embodiments presented herein.

In one embodiment, the example computer program product 900 is provided using a signal bearing medium 901. The signal bearing medium 901 may include one or more programming instructions 902 that, when executed by one or more processors may provide functionality or portions of the functionality described above with respect to FIGS. 1-8. In some examples, the signal bearing medium 901 may encompass a computer-readable medium 903, such as, but not limited to, a hard disk drive, a Compact Disc (CD), a Digital Video Disk (DVD), a digital tape, memory, etc. In some implementations, the signal bearing medium 901 may encompass a computer recordable medium 904, such as, but not limited to, memory, read/write (R/W) CDs, R/W DVDs, etc. In some implementations, the signal bearing medium 901 may encompass a communications medium 905, such as, but not limited to, a digital and/or an analog communication medium (e.g., a fiber optic cable, a waveguide, a wired communications link, a wireless communication link, etc.). Thus, for example, the signal bearing medium 901 may be conveyed by a wireless form of the communications medium 905 (e.g., a wireless communications medium conforming to the IEEE 802.11 standard or other transmission protocol).

The one or more programming instructions 902 may be, for example, computer executable and/or logic implemented instructions. In some examples, a computing device such as the programmable devices 708*a-c* in FIG. 7, or the computing devices 818*a-c* of FIG. 8B may be configured to provide various operations, functions, or actions in response to the programming instructions 902 conveyed to programmable devices 708*a-c* or the computing devices 818*a-c* by one or more of the computer readable medium 903, the computer recordable medium 904, and/or the communications medium 905.

It should be understood that arrangements described herein are for purposes of example only. As such, those skilled in the art will appreciate that other arrangements and other elements (e.g. machines, interfaces, functions, orders, and groupings of functions, etc.) can be used instead, and some elements may be omitted altogether according to the desired results. Further, many of the elements that are described are functional entities that may be implemented as discrete or distributed components or in conjunction with other components, in any suitable combination and location.

While various aspects and embodiments have been disclosed herein, other aspects and embodiments will be apparent to those skilled in the art. The various aspects and embodiments disclosed herein are for purposes of illustration and are not intended to be limiting, with the true scope being indicated by the following claims, along with the full scope of equivalents to which such claims are entitled. It is also to be understood that the terminology used herein is for the purpose of describing particular embodiments only, and is not intended to be limiting.

What is claimed is:

1. A method, comprising:

determining one or more characteristics of an environment of a device, wherein the device includes a text-to-speech module, wherein the one or more characteristics include one or more characteristics of a background sound in the environment of the device, and wherein the one or more characteristics of the environment are time-varying;

determining, based on the one or more characteristics of the environment, one or more speech parameters that characterize a voice output of the text-to-speech module, wherein determining the one or more speech parameters comprises:

determining a transform to convert a first set of speech parameters determined for a substantially sound-free background environment to a second set of speech parameters that includes Lombard parameters determined for a given environment with a previously determined background sound condition, wherein the Lombard parameters are determined such that the voice output is intelligible in the previously determined background sound condition, modifying, based on the one or more characteristics, the transform, and applying the modified transform to one of (i) the first set of speech parameters, and (ii) the Lombard parameters to obtain the one or more speech parameters; and processing, by the text-to-speech module, a text to obtain the voice output corresponding to the text based on the one or more speech parameters to account for the one or more characteristics of the environment.

2. The method of claim 1, wherein the one or more speech parameters include one or more of volume, duration, pitch, and spectrum.

3. The method of claim 1, wherein the one or more characteristics of the background sound include one or more of (i) signal-to-noise ratio (SNR) relating to the background sound, (ii) background sound pressure level, or (iii) type of the background sound.

4. The method of claim 1, wherein determining the one or more speech parameters comprises extrapolating or interpolating between the first set of speech parameters and the Lombard parameters, based on the one or more characteristics.

5. The method of claim 1, wherein processing the text comprises:

synthesizing a voice signal from the text based on one or more speech waveforms pre-recorded in a given environment having one or more predetermined characteristics; and modifying, using the one or more speech parameters, the voice signal to obtain the voice output of the text.

6. The method of claim 5, wherein the one or more speech waveforms are pre-recorded in the substantially sound-free background environment.

7. The method of claim 5, wherein the voice output corresponding to the text differs from the synthesized voice signal in one or more of volume, duration, pitch, and spectrum to account for the one or more characteristics of the environment of the device.

8. The method of claim 5, wherein modifying the synthesized voice signal comprises scaling, based on the one or more speech parameters, one or more signal parameters of the synthesized voice signal by a factor, wherein the one or more speech parameters include one or more of volume, duration, pitch, and spectrum.

9. The method of claim 1, wherein processing the text comprises:

determining, using the one or more speech parameters, a Hidden Markov Model generated to model a parametric representation of spectral and excitation parameters of speech; and synthesizing, using the Hidden Markov Model, a speech waveform to generate the voice output corresponding to the text.

10. The method of claim 1, wherein the one or more speech parameters are time-varying.

11. The method of claim 10, wherein determining the one or more speech parameters comprises determining the one or more speech parameters in real-time to account for the time-varying characteristics of the environment.

12. A system comprising:

a device including a text-to-speech module; and a processor coupled to the device, and the processor is configured to:

determine one or more characteristics of an environment of the device, wherein the one or more characteristics include one or more characteristics of a background sound in the environment of the device, and wherein the one or more characteristics of the environment are time-varying;

determine, based on the one or more characteristics of the environment, one or more speech parameters that characterize a voice output of the text-to-speech module, wherein, to determine the one or more speech parameters, the processor is configured to:

determine a transform to convert a first set of speech parameters determined for a substantially sound-free background environment to a second set of speech parameters that includes Lombard parameters determined for a given environment with a previously determined background sound condition, wherein the Lombard parameters are determined such that the voice output is intelligible in the previously determined background sound condition, modify, based on the one or more characteristics, the transform, and apply the modified transform to one of (i) the first set of speech parameters, and (ii) the Lombard parameters to obtain the one or more speech parameters; and process a text to obtain the voice output corresponding to the text based on the one or more speech parameters to account for the one or more characteristics of the environment.

13. The system of claim 12, further comprising:

an audio capture unit coupled to the device, wherein the one or more characteristics include one or more characteristics of a background sound received from the audio capture unit; and a memory coupled to the processor, and the memory is configured to store (i) the first set of speech parameters corresponding to the substantially sound-free background environment, and (ii) the second set of speech parameters that are Lombard parameters determined for the given environment with the previously determined background sound condition.

14. A non-transitory computer readable medium having stored thereon instructions that, when executed by a computing device, cause the computing device to perform functions comprising:

determining one or more characteristics of an environment, wherein the one or more characteristics include one or more characteristics of a background sound in the environment of the device, and wherein the one or more characteristics of the environment are time-varying;

determining, based on the one or more characteristics of the environment, one or more speech parameters that characterize a voice output of a text-to-speech module coupled to the computing device, wherein determining the one or more speech parameters comprises extrapolating or interpolating, based on the one or more characteristics, between a first set of speech parameters determined for a substantially background sound-free environment and a second set of speech parameters that are Lombard parameters determined for a given environment with a previously determined background sound condition, wherein the Lombard parameters are determined such that the voice output is intelligible in the previously determined background sound condition;

processing, by the text-to-speech module, a text to obtain the voice output corresponding to the text based on the one or more speech parameters to account for the one or more characteristics of the environment.

15. The non-transitory computer readable medium of claim 14, wherein the function of processing the text to obtain the voice output comprises:

synthesizing a voice signal from the text based on one or more speech waveforms pre-recorded in a substantially sound-free background environment; and modifying, using the one or more speech parameters, the synthesized voice signal to obtain the voice output corresponding to the text such that the voice output corresponding to the text is intelligible in the environment.

16. The non-transitory computer readable medium of claim 15, wherein the function of modifying the synthesized voice signal comprises scaling, based on the one or more speech parameters, one or more signal parameters of the synthesized voice signal by a factor, wherein the one or more speech parameters include one or more of volume, duration, pitch, and spectrum.

17. The non-transitory computer readable medium of claim 14, wherein the one or more characteristics of the background sound include one or more of (i) signal-to-noise ratio (SNR)

relating to the background sound, and (ii) type of the background sound, and wherein the functions further comprise updating the one or more speech parameters in real-time to account for the time-varying characteristics of the environment.

* * * * *